US009944478B2

(12) United States Patent
Kasaishi et al.

(10) Patent No.: US 9,944,478 B2
(45) Date of Patent: Apr. 17, 2018

(54) SHEET SUPPORTING APPARATUS AND IMAGE FORMING APPARATUS

(71) Applicant: CANON KABUSHIKI KAISHA, Tokyo (JP)

(72) Inventors: Takugo Kasaishi, Tokyo (JP); Daisuke Aoki, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 4 days.

(21) Appl. No.: 15/160,078

(22) Filed: May 20, 2016

(65) Prior Publication Data

US 2016/0347564 A1 Dec. 1, 2016

(30) Foreign Application Priority Data

May 28, 2015 (JP) ..... 2015-108834

(51) Int. Cl.
*B65H 5/36* (2006.01)
*B65H 1/04* (2006.01)
(Continued)

(52) U.S. Cl.
CPC ..... *B65H 5/36* (2013.01); *B65H 1/04* (2013.01); *B65H 1/266* (2013.01); *B65H 5/062* (2013.01); *B65H 2402/31* (2013.01); *B65H 2402/32* (2013.01); *B65H 2402/46* (2013.01); *B65H 2402/5155* (2013.01);
(Continued)

(58) Field of Classification Search
CPC . B65H 1/04; B65H 1/266; B65H 5/36; B65H 2402/31; B65H 2402/32; B65H 2402/46; B65H 2404/50; B65H 2404/60; B65H 2405/10; B65H 2405/32;
(Continued)

(56) References Cited

U.S. PATENT DOCUMENTS 5,320,338 A 6/1994 Shinohara et al.
6,382,617 B1 * 5/2002 Yen ..... B41J 13/103 271/126
(Continued)

FOREIGN PATENT DOCUMENTS

CN 1075368 A 8/1993
CN 1151361 A 6/1997
(Continued)

OTHER PUBLICATIONS

Chinese Office Action dated Nov. 3, 2017; in corresponding Chinese Application No. 201610357064.6.

*Primary Examiner* — Prasad V Gokhale
(74) *Attorney, Agent, or Firm* — Fitzpatrick, Cella, Harper & Scinto

(57) ABSTRACT

A sheet supporting apparatus includes an apparatus body, a supporting unit being capable of being drawn from and inserted to the apparatus body, and having a supporting member on which a sheet is supported, a conveyance guide disposed on the apparatus body and being capable of moving to a first position at which a sheet conveyance path is constituted, and a second position distant from the first position, and a regulation unit. The regulation unit regulates the conveyance guide positioned at the second position from moving in an upward direction, a downward direction, a drawing direction and an inserting direction of a supporting unit.

17 Claims, 13 Drawing Sheets

(51) Int. Cl.
*B65H 1/26* (2006.01)
*B65H 5/06* (2006.01)

(52) U.S. Cl.
CPC ..... *B65H 2404/134* (2013.01); *B65H 2404/1441* (2013.01); *B65H 2404/152* (2013.01); *B65H 2404/16* (2013.01); *B65H 2405/332* (2013.01); *B65H 2407/21* (2013.01); *B65H 2601/324* (2013.01); *B65H 2801/12* (2013.01)

(58) Field of Classification Search
CPC ..... B65H 2405/332; B65H 2405/354; B65H 2407/21; B65H 2601/324
USPC ..... 271/264
See application file for complete search history.

(56) References Cited

U.S. PATENT DOCUMENTS

| | | | | |
|---|---|---|---|---|
| 6,994,341 | B2 | 2/2006 | Aoki et al. | |
| 7,731,180 | B2 | 6/2010 | Ohnishi | |
| 8,523,466 | B2 | 9/2013 | Mizuguchi et al. | |
| 8,960,664 | B2 * | 2/2015 | Maeda | B65H 1/00 271/162 |
| 9,024,984 | B2 | 5/2015 | Akatsuka et al. | |
| 9,056,745 | B2 | 6/2015 | Harada et al. | |
| 9,533,849 | B2 * | 1/2017 | Kasaishi | B65H 5/36 |
| 2002/0130458 | A1 * | 9/2002 | Okada | B65H 1/266 271/9.12 |
| 2010/0172678 | A1 * | 7/2010 | Kim | B65H 1/266 399/393 |
| 2011/0206441 | A1 * | 8/2011 | Mizuguchi | B65H 5/38 400/642 |
| 2013/0228967 | A1 * | 9/2013 | Maeda | B65H 1/00 271/264 |
| 2015/0061219 | A1 | 3/2015 | Murakami et al. | |
| 2015/0115526 | A1 | 4/2015 | Harada et al. | |
| 2015/0309460 | A1 * | 10/2015 | Yamamoto | B65H 1/266 271/3.19 |
| 2016/0137444 | A1 * | 5/2016 | Kasaishi | B65H 5/36 271/9.09 |
| 2016/0185138 | A1 * | 6/2016 | Takeuchi | B65H 1/266 271/9.09 |

FOREIGN PATENT DOCUMENTS

| | | | |
|---|---|---|---|
| CN | 101274715 | A | 10/2008 |
| CN | 102190176 | A | 9/2011 |
| JP | H08-040572 | A | 2/1996 |
| JP | 2003-262996 | A | 9/2003 |
| JP | 2008-105791 | A | 5/2008 |
| JP | 2015-086039 | A | 5/2015 |

* cited by examiner

SHEET SUPPORTING APPARATUS AND IMAGE FORMING APPARATUS

BACKGROUND OF THE INVENTION

Field of the Invention

The present invention relates to a sheet supporting apparatus supporting sheets, and an image forming apparatus utilizing the sheet supporting apparatus.

Description of the Related Art

Hitherto, image forming apparatuses adopting an electrophotographic system are widely applied as copiers, printers, plotters, facsimile machines, and multifunction machines having such multiple functions. An image forming apparatus including a sheet supporting apparatus supporting a large number of sheets is becoming widespread. For example, Japanese unexamined patent application publication No. 2008-105791 teaches a widely-used sheet supporting apparatus having a sheet supporting unit capable of supporting a large number of sheets, and a conveyance guide for manual sheet feed. In this type of sheet supporting apparatus, the conveyance guide is disposed movably to a sheet conveyance position disposed upward of the sheet supporting unit and forming a sheet conveyance path, and a freeing position freeing the sheet conveyance path.

In this type of image forming apparatus, in order to form an image on a sheet having a regular, frequently-used size, the user stacks sheets on a sheet supporting unit, and the sheets are fed one at a time from the uppermost sheet by a sheet feeding unit. In order to form an image on a sheet having a regular size but not used frequently, such as a cardboard, or on a special sheet having a size other than the regular size, such as a long sheet, the user feeds the sheet manually on the conveyance guide.

In the image forming apparatus, a feed roller is disposed above the conveyance guide. When replacing the feed roller, for example, operation is performed in a state where the conveyance guide is positioned at the freeing position.

However, the above-described sheet supporting apparatus does not adopt a configuration of regulating movement of the conveyance guide positioned at the freeing position with respect to the apparatus body. Therefore, when the conveyance guide is positioned at the freeing position to replace the feed roller, the conveyance guide may be moved with respect to the apparatus body, hindering the replacement operation of the feed roller.

Especially, when the apparatus body is turned 90 degrees and erected so that a bottom portion of the apparatus body is visible from the side with the aim to facilitate the replacement operation of the feed roller, the conveyance guide may move by its own weight and hide the feed roller, or narrow the operation space. If the replacement operation of the feed roller is continued in this state, operation time is elongated by the deteriorated workability. It may be possible to remove the conveyance guide from the apparatus body to improve the workability during replacement of the feed roller, but an operation of removing the conveyance guide must be additionally performed, and the operation time could not be shortened easily. Such drawback does not only occur at the timing of replacement of the feed roller, but may occur during general maintenance operation, such as replacement or inspection of an internal component, of an apparatus body having its workability possibly deteriorated by the movement of the conveyance guide in the freeing position.

SUMMARY OF THE INVENTION

The present invention provides a sheet supporting apparatus including an apparatus body, a supporting unit being capable of being drawn from and inserted to the apparatus body, and comprising a supporting member on which a sheet is supported, a conveyance guide disposed on the apparatus body and being capable of moving to a first position at which a sheet conveyance path is constituted, and a second position distant from the first position, and a regulation unit regulating the conveyance guide positioned at the second position from moving in an upward direction, a downward direction, a drawing direction and an inserting direction of a supporting unit.

Further features of the present invention will become apparent from the following description of exemplary embodiments with reference to the attached drawings.

DESCRIPTION OF THE EMBODIMENTS

First Embodiment

Now, a first embodiment of the present invention will be described in detail with reference to FIGS. 1 through 12. The present embodiment illustrates a tandem-type full-color printer as an example of an image forming apparatus. However, the present invention is not restricted to tandem-type full-color image forming apparatuses, but can be other types of image forming apparatuses, or can be monochrome or mono-color.

Figure 1:
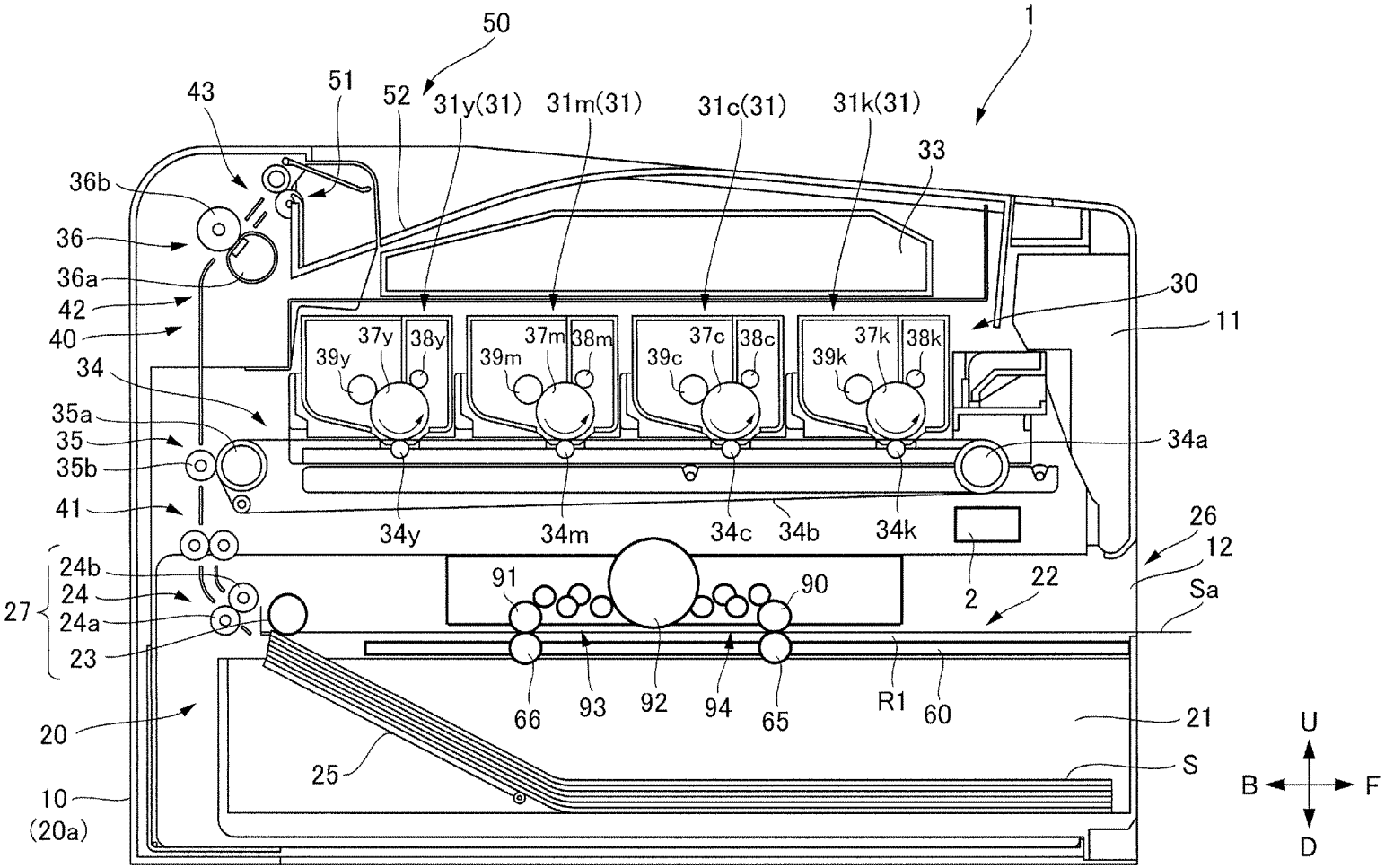
FIG. 1 is a schematic cross-sectional view of an image forming apparatus according to a first embodiment.

As illustrated in FIG. 1, an image forming apparatus 1 includes an image forming apparatus body (hereinafter referred to as apparatus body) 10. The apparatus body 10 includes a sheet feeding unit, i.e., sheet supporting apparatus, 20, an image forming unit 30, a sheet conveyance unit 40, a sheet discharge unit 50, and a control unit 2. A sheet S, i.e., recording member, has a toner image formed thereto, and actual examples of the sheets include plain paper, synthetic resin sheet as a substitute of plain paper, cardboard, OHP sheet, and so on. Further, the apparatus body 10 includes a door 11.

In the present embodiment, a side on which the door 11 is provided, that is, the side from which a sheet cassette 21 described later is drawn out, is referred to as a front side of the image forming apparatus 1. Further, in the respective drawings, a front side direction is referred to as frontward F, a direction opposite therefrom toward a direction in which the sheet cassette 21 is inserted is referred to as backward B, and an upper direction in a state facing the door 11 is referred to as upward U, a lower direction is referred to as downward D, a left side direction is referred to as leftward L, and a right side direction is referred to as rightward R. Moreover, a front and back direction may also be referred to as an inserting and drawing direction of the sheet cassette 21, and a left and right direction may also be referred to as a width direction W.

A sheet feeding unit 20 is disposed below the apparatus body 10, and configured to feed sheets S to the image forming unit 30. The sheet feeding unit 20 includes an apparatus body 20*a*, a sheet cassette, i.e., supporting unit, 21 capable of supporting sheets S, a conveyance guide 22, a roller unit 27, and a regulation unit 28 (refer to FIG. 6). In the present embodiment, the apparatus body 20*a* of the sheet feeding unit 20 is composed of a part of the apparatus body 10 of the image forming apparatus 1. A bottom portion 10*b* of the sheet feeding unit 20 is freed, so that when the sheet cassette 21 is removed from the sheet feeding unit 20, the conveyance guide 22 is exposed downward D. The roller unit 27 is disposed further rearward of a trailing edge of the conveyance guide 22, and the roller unit 27 is also exposed downward D. That is, the apparatus body 10 has the bottom portion 10*b* defining an opening 100 rearward of the conveyance guide 22 through which the roller unit 27 is exposed to the exterior (refer to FIG. 12).

The sheet cassette 21 can be drawn out from and inserted to the apparatus body 10, and includes an intermediate plate, i.e., supporting member, 25 on which sheets S are supported. In other words, the sheet cassette 21 is disposed in an attachable and removable manner with respect to the apparatus body 10. The intermediate plate 25 supports the supported sheets S, and is configured to push up the sheets S stored in the sheet cassette 21 and press the sheets against the roller unit 27. Horizontal linear sliding portions, i.e., guidance portions, 21*a* disposed with the front and back direction set as the longitudinal direction are provided on both side portions in the width direction W of the sheet cassette 21 (refer to FIG. 3).

The roller unit 27 includes a feed roller 23 and a separation mechanism 24, and is disposed in an attachable and removable manner to a sheet conveyance path of the apparatus body 10. The separation mechanism 24 comprises a conveyance roller 24*a* and a separation roller, i.e., separation unit, 24*b*. The conveyance roller 24*a* and the separation roller 24*b* are in pressure contact with one another, and separate the sheets S fed from the feed roller 23 one by one. That is, the feed roller 23 is capable of feeding the sheets S supported on the intermediate plate 25. Further, the conveyance roller 24*a* is disposed downstream, in a sheet conveyance direction, of the feed roller 23, and cooperates with the separation roller 24*b* to separate the sheets S fed from the feed roller 23 one by one. In the present embodiment, the separation unit is composed of the separation roller 24*b*, but the configuration is not restricted thereto, and the separation unit can also be composed of a non-rotating friction plate.

A manual sheet feed port 12 is disposed between the conveyance guide 22 and the door 11. A manual sheet feed portion 26 utilizing a sheet conveyance path R1 is disposed backward B of the manual sheet feed port 12. Drive rollers, i.e., second roller portions, 90 and 91 disposed in the apparatus body 10, and driven rollers, i.e., first roller portions, 65 and 66 in pressure contact with the respective drive rollers 90 and 91 and disposed on the conveyance guide 22 are arranged on the sheet conveyance path R1. Transfer nips are respectively formed at a pressure contact portion between the drive roller 90 and the driven roller 65, and at a pressure contact portion between the drive roller 91 and the driven roller 66. A manually-fed sheet Sa set to the conveyance guide 22 from the manual sheet feed port 12 is conveyed via the drive rollers 90 and 91 and reaches the separation mechanism 24 via the feed roller 23. That is, the conveyance guide 22 conveys the manually-fed sheet Sa from the manual sheet feed portion 26 through the sheet conveyance path R1. The drive rollers 90 and 91 have a drive motor 92 as a drive source, and are rotated via gear trains 93 and 94. Further, the feed roller 23 and the conveyance roller 24*a* have the drive motor 92 as the drive source, and are rotated via a gear train not illustrated. The details of the sheet feeding unit 20 will be described later.

The image forming unit 30 includes an image forming unit 31, a laser scanner 33, an intermediate transfer unit 34, a secondary transfer unit 35, and a fixing unit 36, and forms images on a sheet conveyed through the sheet conveyance unit 40.

The image forming unit 31 includes four image forming units 31*y*, 31*m*, 31*c* and 31*k* forming toner images of four colors, which are yellow (y), magenta (m), cyan (c) and black (k). For example, the image forming unit 31*y* includes a photosensitive drum 37*y* forming a toner image, a charging roller 38*y*, a developing sleeve 39*y*, a drum cleaning blade not shown, a toner, and so on. The toner is stored in a container within the image forming unit 31*y*. The other image forming units 31*m*, 31*c* and 31*k* have similar configurations as the image forming unit 31*y*, except for the difference in toner colors, so that detailed descriptions thereof are omitted.

The laser scanner 33 exposes the surfaces of the photosensitive drums 37*y*, 37*m*, 37*c* and 37*k*, and forms electrostatic latent images on the surface.

The intermediate transfer unit 34 includes multiple rollers, such as a drive roller 34*a* and primary transfer rollers 34*y*, 34*m*, 34*c* and 34*k*, and an intermediate transfer belt 34*b* wound around these rollers. The primary transfer rollers 34*y*, 34*m*, 34*c* and 34*k* are respectively opposed to the photosensitive drums 37*y*, 37*m*, 37*c* and 37*k*, and abutted against the intermediate transfer belt 34*b*. By applying a transfer bias of positive polarity by the primary transfer rollers 34*y*, 34*m*, 34*c* and 34*k* to the intermediate transfer belt 34*b*, toner images having negative polarity formed respectively on the photosensitive drums 37*y*, 37*m*, 37*c* and 37*k* are sequentially superimposed and transferred to the intermediate transfer belt 34*b*. Thereby, a full-color image is formed on the intermediate transfer belt 34*b*.

The secondary transfer unit 35 includes a secondary transfer inner roller 35*a* and a secondary transfer outer roller 35*b*. The full-color image formed on the intermediate transfer belt 34*b* is configured to be transferred onto the sheet S by applying a secondary transfer bias having positive polarity to the secondary transfer outer roller 35*b*. The secondary transfer inner roller 35*a* is arranged on an inner side of the intermediate transfer belt 34*b*, and stretching the intermediate transfer belt 34*b*, with the secondary transfer outer roller 35*b* positioned to face the secondary transfer inner roller 35*a* with the intermediate transfer belt 34*b* nipped therebetween.

The fixing unit 36 includes a fixing roller 36*a* and a pressure roller 36*b*. When a sheet S is nipped and conveyed between the fixing roller 36*a* and the pressure roller 36*b*, the toner image transferred onto the sheet S is heated, pressed and fixed onto the sheet S.

The sheet conveyance unit 40 includes a pre-secondary-transfer conveyance path 41, a pre-fixing conveyance path 42 and a discharge path 43, configured so that the sheet S supported on the sheet feeding unit 20 can be conveyed from the image forming unit 30 to the sheet discharge unit 50.

The sheet discharge unit 50 includes a sheet discharge roller pair 51 disposed downstream of the discharge path 43, and a sheet discharge tray 52 disposed downstream of the sheet discharge roller pair 51. The sheet discharge roller pair 51 is configured to feed the sheet S conveyed from the discharge path 43 through the nip portion, and discharge the sheet S onto the sheet discharge tray 52.

The control unit 2 is composed of a computer, and includes, for example, a CPU, a ROM storing programs controlling respective units, a RAM storing temporal data, and an input/output circuit (I/F) inputting/outputting signals from/to an exterior. The CPU is a microprocessor administrating the overall control of the image forming apparatus 1, and it is a subject of a system controller. The CPU is connected via the input/output circuit to the sheet feeding unit 20, the image forming unit 30, the sheet conveyance unit 40 and the sheet discharge unit 50, and configured to communicate signals with the respective units and control operations thereof.

Next, an image forming operation according to the image forming apparatus 1 configured in this manner will be described.

When the image forming operation is started, at first, the photosensitive drums 37*y*, 37*m*, 37*c* and 37*k* rotate, and the surfaces thereof are charged by charging rollers 38*y*, 38*m*, 38*c* and 38*k*. Then, laser beams are irradiated from the laser scanner 33 to the photosensitive drums 37*y*, 37*m*, 37*c* and 37*k* based on image information, and electrostatic latent images are formed on the surface of the photosensitive drums 37*y*, 37*m*, 37*c* and 37*k*. By having toner adhere to the electrostatic latent images, the images are developed and visualized as toner images. At this time, an amount of toner being developed increases as a potential difference, which is the difference between an exposure amount and a bias applied to each of the developing sleeves 39*y*, 39*m*, 39*c* and 39*k*, increases. The visualized toner images are transferred to the intermediate transfer belt 34*b*.

Meanwhile, in parallel with such toner image forming operation, the feed roller 23 is rotated, separating and feeding an uppermost sheet S of the sheet cassette 21. Then, the sheet S is conveyed via the pre-secondary-transfer conveyance path 41 to the secondary transfer unit 35 at a timing matching the toner image on the intermediate transfer belt 34*b*. Further, the sheet S on which an image has been transferred from the intermediate transfer belt 34*b* is conveyed to the fixing unit 36, where heat and pressure is applied to the non-fixed toner image to fix the image on the surface of the sheet S, and then the sheet S is discharged through the sheet discharge roller pair 51 and stacked on the sheet discharge tray 52.

Furthermore, when feeding the sheet S manually, the user inserts a manually-fed sheet Sa through the manual sheet feed port 12 to the conveyance guide 22 of the manual sheet feed portion 26, by which the sheet S is sent into the sheet conveyance path R1. The sheet conveyance path R1 for manual sheet feed is continued from the manual sheet feed port 12 to the separation mechanism 24. The manually-fed sheet Sa set through the manual sheet feed port 12 to the conveyance guide 22 is conveyed by drive rollers 90 and 91, passes the feed roller 23 and reaches the separation mechanism 24. A color toner image is transferred and fixed to the manually-fed sheet Sa having reached the separation mechanism 24, similarly as the sheet S supported in the sheet cassette 21, and discharged onto the sheet discharge tray 52.

Next, the sheet feeding unit 20 in the above-mentioned image forming apparatus 1 will be described in detail with reference to FIGS. 2 through 11.

Figure 2:
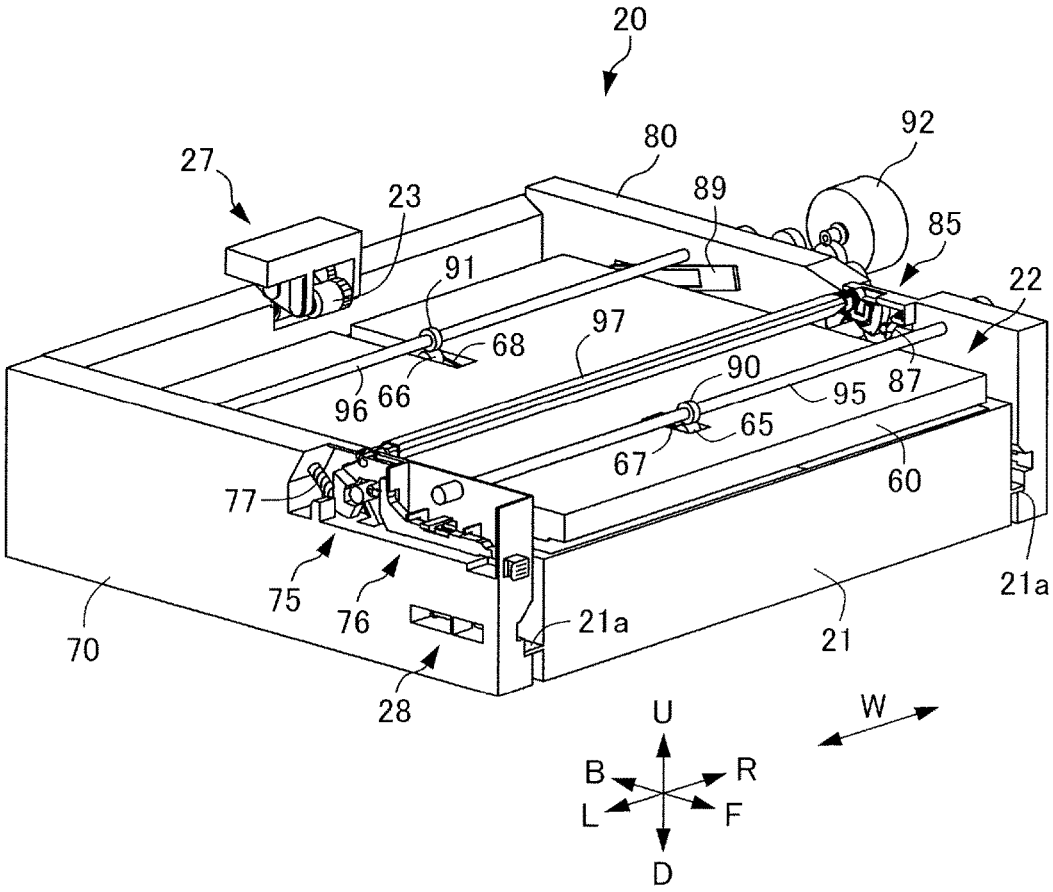
FIG. 2 is a schematic perspective view of a sheet supporting apparatus of the image forming apparatus according to the first embodiment.
Figure 3:
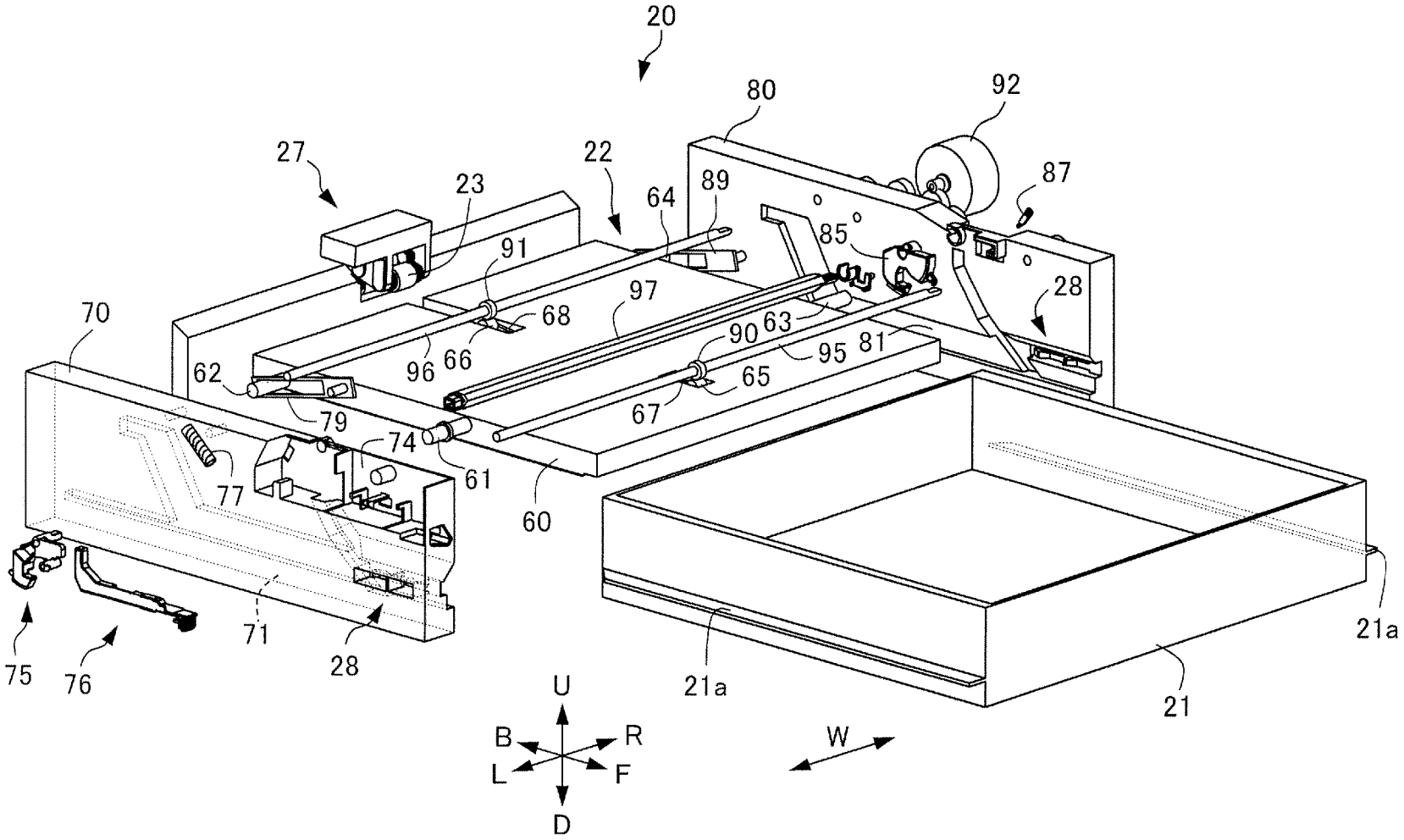
FIG. 3 is a schematic exploded perspective view of the sheet supporting apparatus of the image forming apparatus according to the first embodiment.

As illustrated in FIGS. 2 and 3, the sheet feeding unit 20 includes support plates 70 and 80 arranged on left and right side portions of the sheet cassette 21 and the conveyance guide 22. The respective support plates 70 and 80 have the front and back directions set as the longitudinal directions. Drive rollers 90 and 91 are respectively supported by rotation shafts 95 and 96 rotated via the drive motor 92 between the respective support plates 70 and 80.

The conveyance guide 22 of the sheet feeding unit 20 includes a guide plate 60, and guide projections, i.e., engagement portions or pin members, 61 through 64 protruding sidewise, i.e., width direction, from front and rear portions of the left and right sides of the guide plate 60. Further, the conveyance guide 22 includes driven rollers 65 and 66 supported rotatably on the guide plate 60, and biasing springs, i.e., biasing portions, 67 and 68 (refer to FIG. 8B). In the present embodiment, the conveyance guide 22 is disposed upward U of the sheet cassette 21. The sheet conveyance path R1 is formed on an upper surface side of the guide plate 60. The respective guide projections 61 through 64 are disposed to protrude from an end portion of the conveyance guide 22 in a width direction W orthogonal to a movement direction. The respective guide projections 61 through 64 are guided by the respective support plates 70 and 80 in the up and down direction or the front and back direction. In the present embodiment, the respective guide projections 61 through 64 are disposed at end portions in the width direction W of the conveyance guide 22, but are not restricted thereto, and can be disposed at areas on side portions positioned on inner sides of the end portions in the width direction W of the conveyance guide 22.

Figure 4:
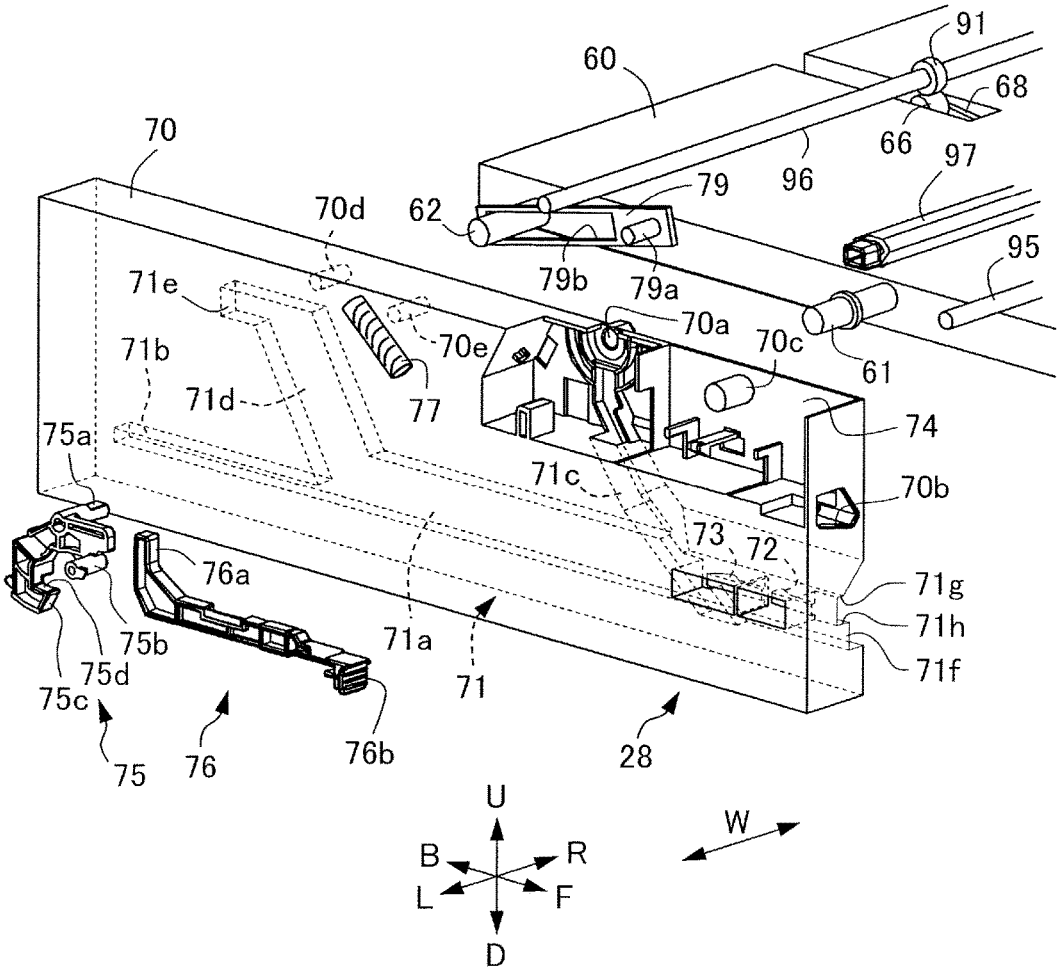
FIG. 4 is a schematic exploded perspective view of a circumference of a left side support plate of the sheet supporting apparatus according to the first embodiment.

As shown in FIG. 4, the support plate 70 on the left side has a guide groove, i.e., conveyance guidance portion or supporting portion, 71 opened toward an inner side. The guide groove 71 includes a horizontal portion, i.e., horizontal groove, 71*a*, a rear side horizontal portion 71*b*, a front side oblique portion, i.e., oblique groove, 71*c*, a rear side oblique portion 71*d*, and a rear side step portion 71*e*. The horizontal portion 71*a* is formed from a leading edge portion of the support plate 70 so that the front and rear direction is set as the longitudinal direction. The rear side horizontal portion 71*b* is extended further backward B from the trailing edge of the horizontal portion 71*a*, and formed to have a narrower width than the horizontal portion 71*a*. The front side oblique portion 71*c* is formed from the front portion of the horizontal portion 71*a* diagonally upward in a backward direction. The rear side oblique portion 71*d* is formed from the trailing edge portion of the horizontal portion 71*a* diagonally upward in the backward direction. The rear side step portion 71*e* is formed from an upper end portion of the rear side oblique portion 71*d* in the backward direction.

The guide projection 61 on the left front side of the conveyance guide 22 is configured to engage with a front portion of the horizontal portion 71*a* and the front side oblique portion 71*c* and capable of moving in sliding motion. The guide projection 62 on the left back side of the conveyance guide 22 is configured to engage with the horizontal portion 71*a*, the rear side oblique portion 71*d* and the rear side step portion 71*e*, and capable of moving in sliding motion. A sliding portion 21*a* disposed on a left side of the sheet cassette 21 is supported slidably in the drawing and inserting direction by the horizontal portion 71*a* and the rear side horizontal portion 71*b*.

That is, the guide groove 71 includes the horizontal portion 71*a* disposed horizontally from the drawing direction side toward the inserting direction of the apparatus body 20*a*, and the front side oblique portion 71*c* disposed to intersect with an intersect portion 71*x* with respect to the horizontal portion 71*a* and formed diagonally upward U in the inserting direction from the intersect portion 71*x*. When the conveyance guide 22 is positioned at a first position, the guide projection is positioned at an uppermost portion of the front side oblique portion 71*c*, and when the conveyance guide 22 is positioned at a second position, the guide projection 61 is positioned at the drawing direction side than the intersect portion 71*x* of the horizontal portion 71*a*.

Further, a lower front section of the horizontal portion 71*a* is formed as a shallow groove, defining a stopper 71*f*. The stopper 71*f* is formed to such a depth not allowing the guide projections 61 and 62 to pass through but allowing the sliding portion 21*a* to pass through. A first mold spring, i.e., first contact portion, 72 protruding inward at the front side, and a second mold spring, i.e., second contact portion, 73 protruding inward at an adjacent portion backward B of the first mold spring 72 are disposed at the upper side of the stopper 71*f*. The first mold spring 72 is elastically deformable in the width direction W, and has an inclined plane 72*a* facing the inner frontward direction, and a stopper plane 72*b* facing the backward direction (refer to FIG. 11). The second mold spring 73 is elastically deformable in the width direction W, and has an inclined plane 73*a* facing the inner frontward direction, and an inclined plane 73*b* facing the inner backward direction (refer to FIG. 11). An upper wall, i.e., first wall portion, 71*g* of the horizontal portion 71*a*, an upper surface, i.e., second wall portion, 71*h* of the stopper 71*f*, the first mold spring 72 and the second mold spring 73 constitute the regulation unit 28 of the support plate 70. That is, the regulation unit 28 is disposed at a position not interfering with the guide groove 71.

Further, the support plate 70 has a bearing hole 70*c* opening to the inner side and rotatably supporting a rotation shaft 95, and a bearing hole 70*d* opening to the inner side and rotatably supporting a rotation shaft 96. A link member 79 is formed on the guide projection 62. The link member 79 has a rotation shaft 79*a*, and a cam hole 79*b* through which the guide projection 62 passes. The support plate 70 has a bearing hole 70*e* rotatably supporting the rotation shaft 79*a*.

Figure 5:
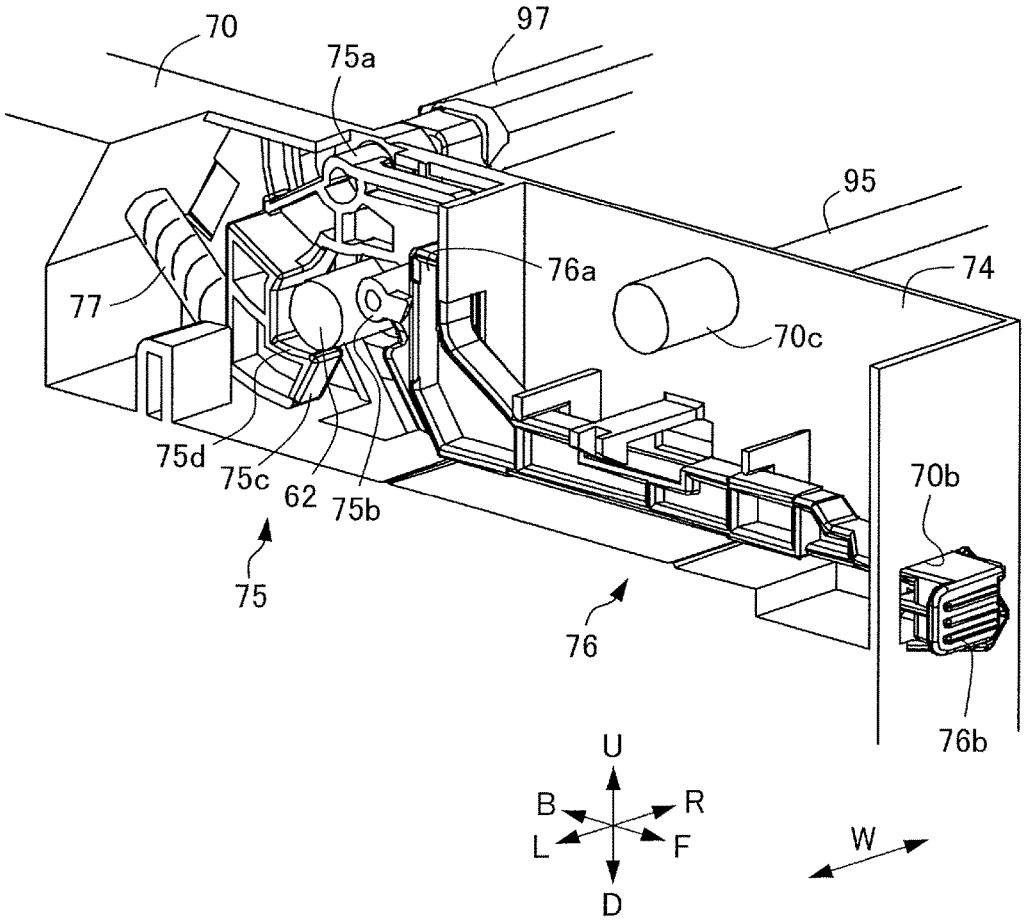
FIG. 5 is a schematic perspective view of a latch member and an operation lever of the sheet supporting apparatus according to the first embodiment.

As illustrated in FIGS. 4 and 5, a dent portion 74 opened to an outer side of the support plate 70 is disposed from the upper portion of the front side oblique portion 71*c* to the leading edge portion of the support plate 70. The dent portion 74 includes a latch member, i.e., lock unit, 75 arranged on an upper portion of the front side oblique portion 71*c*, an operation lever, i.e., unlock unit or operating unit, 76 disposed on a front side of the latch member 75, and a biasing spring 77. That is, the sheet feeding unit 20 includes latch members 75 and 85 capable of locking the conveyance guide 22 to the first position, and the operation lever 76 capable of releasing the latch members 75 and 85.

The latch member 75 includes a rotation shaft 75*a*, a contact portion 75*b* in contact with the operation lever 76, an inclined plane 75*c* to which the guide projection 61 having been elevated within the front side oblique portion 71*c* can contact, and an engagement portion 75*d* with which the guide projection 61 can engage. The rotation shaft 75*a* is rotatably supported by a bearing hole 70*a* formed to the support plate 70. The biasing spring 77 is formed of a compression coil spring, and disposed in a compressed manner between a rear portion of the latch member 75 and a rear side surface of the dent portion 74. Therefore, in FIGS. 4 and 5, the latch member 75 is biased toward a counterclockwise direction. The latch member 75 is connected with a connecting shaft 97 that connects to the rotation shaft 75*a* with respect to the right side latch member 85 (refer to FIG. 6) described later.

The operation lever 76 is disposed slidably in the front and back direction within the dent portion 74. The operation lever 76 has a contact portion 76*a* formed on the trailing edge portion, and a pressing portion 76*b* formed on the leading edge portion. The contact portion 76*a* is capable of being in contact with the contact portion 75*b* of the latch member 75. The pressing portion 76*b* is protruded frontward F from a lever hole 70*b* formed on a leading edge surface of the support plate 70. Thus, when the user presses the pressing portion 76*b* of the operation lever 76 backward B, the operation lever 76 moves backward B, and rotates the latch member 75 against the biasing spring 77 in a clockwise direction in FIGS. 4 and 5.

Figure 6:
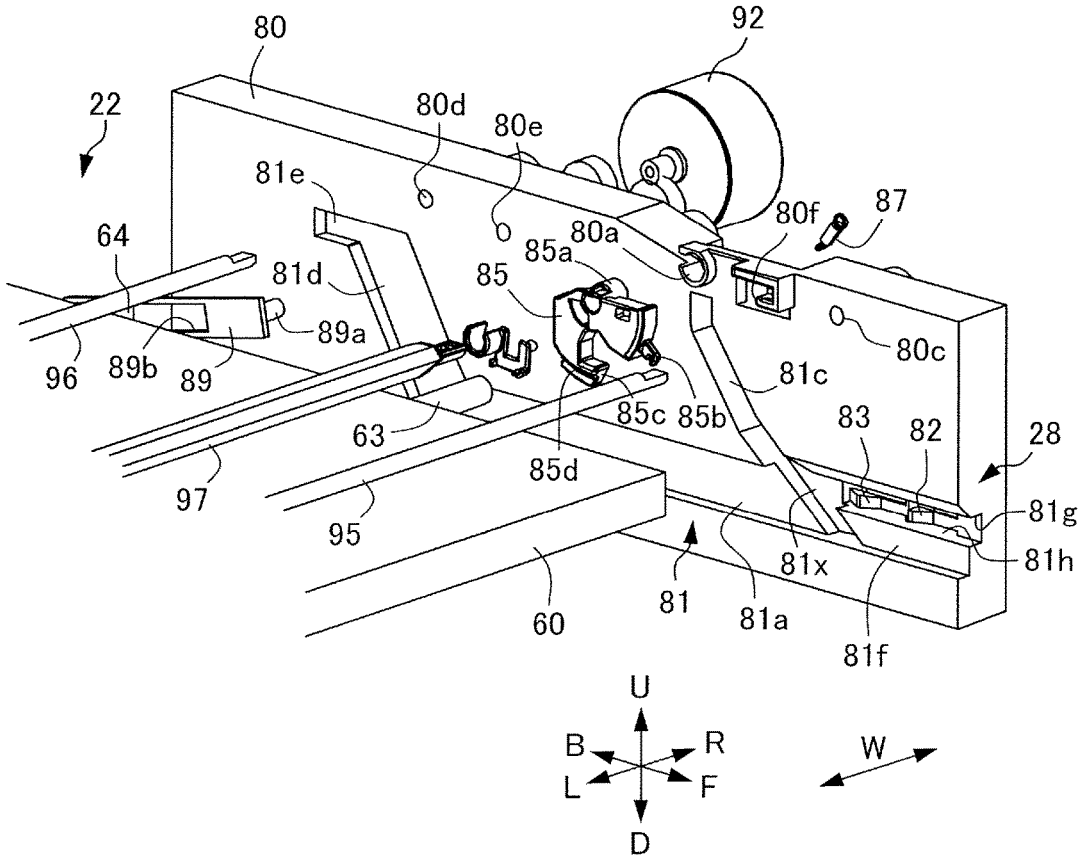
FIG. 6 is a schematic exploded perspective view of a circumference of a right side support plate of the sheet supporting apparatus according to the first embodiment.

As illustrated in FIG. 6, a support plate 80 disposed on the right side has a guide groove, i.e., conveyance guidance portion or supporting portion, 81 opening toward the inner side. The guide groove 81 is formed to have a plane symmetric shape as the guide groove 71, and includes a horizontal portion, i.e., horizontal groove, 81*a*, a rear side horizontal portion, a front side oblique portion, i.e., oblique groove, 81*c*, a rear side oblique portion 81*d*, and a rear side step portion 81*e*. The horizontal portion 81*a* is formed from the leading edge portion of the support plate 80 with the front and back direction set as the longitudinal direction. The rear side horizontal portion is extended further backward B from the trailing edge of the horizontal portion 81*a*, and formed to have a narrower width than the horizontal portion 81*a*. The front side oblique portion 81*c* is formed diagonally upward in the backward direction from the front of the horizontal portion 81*a*. The rear side oblique portion 81*d* is formed diagonally upward in the backward direction from the trailing edge portion of the horizontal portion 81*a*. The rear side step portion 81*e* is formed backward B from the upper end of the rear side oblique portion 81*d*.

A guide projection 63 on a front right side of the conveyance guide 22 is engaged with the front portion of the horizontal portion 81*a* and the front side oblique portion 81*c* in a slidable manner. A guide projection 64 on a rear right side of the conveyance guide 22 is engaged with the horizontal portion 81*a*, the rear side oblique portion 81*d* and the rear side step portion 81*e* in a slidable manner. A sliding portion 21*a* on the right side of the sheet cassette 21 is slidably supported in the drawing direction and the inserting direction by the horizontal portion 81*a* and the rear side horizontal portion 81*b*.

That is, the guide groove 81 includes the horizontal portion 81*a* disposed horizontally from the drawing direction side toward the inserting direction of the apparatus body 20*a*, and the front side oblique portion 81*c* intersecting the horizontal portion 81*a* at an intersect portion 81*x* and disposed diagonally upward U in the inserting direction from the intersect portion 81*x*. When the guide groove 81 is positioned at a first position, the guide projection 63 is positioned at the uppermost portion of the front side oblique portion 81*c*, and when the guide groove 81 is positioned at a second position, the guide projection 63 is positioned at the drawing direction side than the intersect portion 81*x* of the horizontal portion 81*a*.

Therefore, the sheet cassette 21 has the left and right sliding portions 21*a* respectively slidably supported by the horizontal portions 71*a* and 81*a* and the rear side horizontal portion 71*b*, so that the cassette 21 can be slid in the drawing direction and the inserting direction. In the present embodiment, the sheet cassette 21 is slidably supported by the sliding portion 21*a*, the horizontal portions 71*a* and 81*a* and rear side horizontal portion 71*b* with respect to the respective support plates 70 and 80, but a supporting structure is not restricted to a sliding structure. The structure supporting the sheet cassette 21 in a guided manner toward the drawing direction and the inserting direction with respect to the respective support plates 70 and 80 can adopt a known or new appropriate configuration, such as a mechanism for allowing a relatively linear movement using a roller and a rail.

The lower front section of the horizontal portion 81*a* is formed in the shape of a shallow groove, defining a stopper 81*f*. The stopper 81*f* is formed to such a depth not allowing the guide projections 63 and 64 to pass through but allowing the sliding portion 21*a* to pass through. A first mold spring, i.e., first contact portion, 82 protruding inward at the front side and a second mold spring, i.e., second contact portion, 83 protruding inward at an adjacent portion backward B of the first mold spring 82 are disposed at the upper side of the stopper 81*f*. The first mold spring 82 is elastically deformable in the width direction W, and includes an inclined plane 82*a* facing the inner frontward direction, and a stopper plane 82*b* facing the backward direction (refer to FIG. 11). The second mold spring 83 is elastically deformable in the width direction W, including an inclined plane 83*a* facing the inner frontward direction, and an inclined plane 83*b* facing the inner backward direction (refer to FIG. 11). An upper wall, i.e., first wall portion, 81*g* of the horizontal portion 81*a*, an upper surface, i.e., second wall portion, 81*h* of the stopper 81*f*, the first mold spring 82 and the second mold spring 83 constitute the regulation unit 28 of the support plate 80. That is, the regulation unit 28 is disposed at a position not interfering with the guide groove 81.

Further, the support plate 80 has a bearing hole 80*c* formed on the inner side and rotatably supporting the rotation shaft 95, and a bearing hole 80*d* formed on the inner side and rotatably supporting the rotation shaft 96. A link member 89 is formed on the guide projection 64. The link member 89 has a rotation shaft 89*a*, and a cam hole 89*b* through which the guide projection 64 passes. The support plate 80 has a bearing hole 80*e* rotatably supporting the rotation shaft 89*a*.

Figure 7:
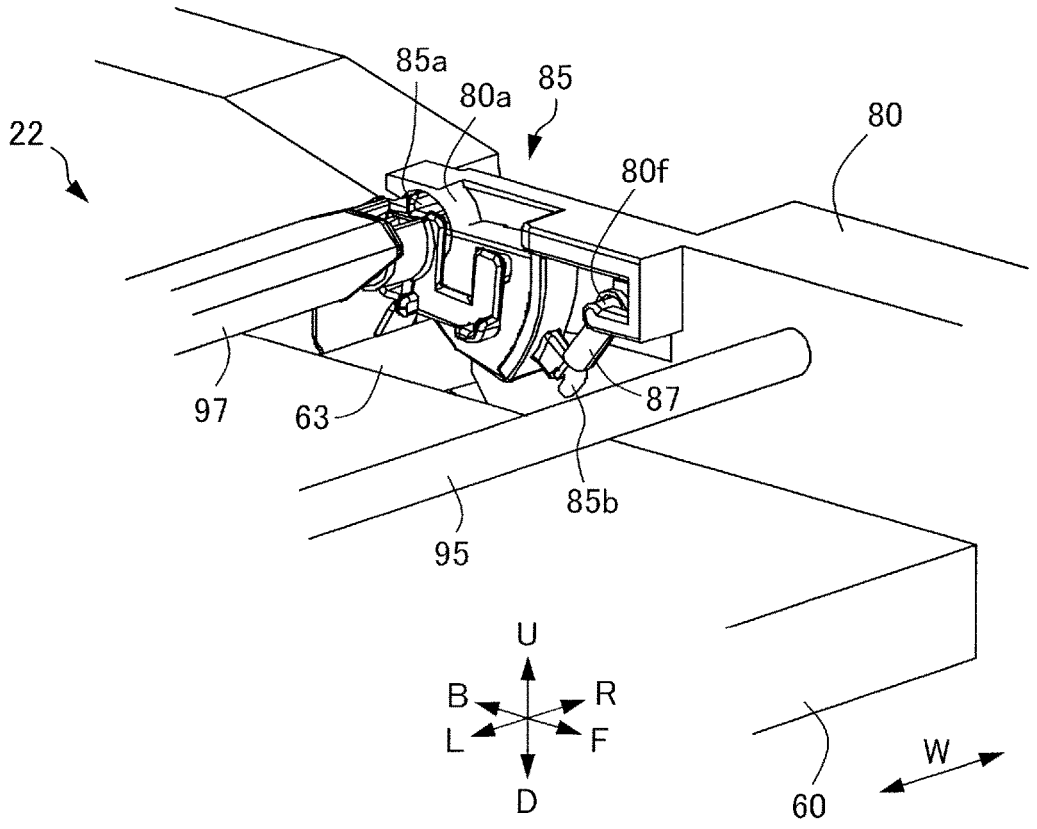
FIG. 7 is a schematic perspective view of the latch member of the sheet supporting apparatus according to the first embodiment.

As illustrated in FIGS. 6 and 7, a latch member, i.e., lock unit, 85 arranged on an upper portion of the front side oblique portion 81*c* and a biasing spring 87 are disposed on the inner side of the support plate 80.

The latch member 85 includes a rotation shaft 85*a*, a hook portion 85*b* to which a biasing spring 87 is hooked, an inclined plane 85*c* to which the guide projection 63 having been elevated within the front side oblique portion 81*c* can contact, and an engagement portion 85*d* capable of engaging the guide projection 63. The rotation shaft 85*a* is rotatably supported by a bearing hole 80*a* formed to the support plate 80. The biasing spring 87 is formed of a compression coil spring, and locked between the hook portion 85*b* of the latch member 85 and the hook portion 80*f* formed on the support plate 80. Therefore, the latch member 85 is biased toward the counterclockwise direction in FIGS. 6 and 7.

The latch member 85 is connected via the connecting shaft 97 to the left side latch member 75 (refer to FIG. 4). Thus, when the user presses the pressing portion 76*b* of the operation lever 76 backwards B, the operation lever 76 moves backward B, and rotates the latch member 85 against the biasing spring 87 via the connecting shaft 97 in a clockwise direction in FIGS. 6 and 7.

Next, the operation of the sheet feeding unit 20 described above will be described in detail with respect to FIGS. 8A through 10B. In FIGS. 8A through 10B, the operation of the left side portion of the sheet feeding unit 20 is illustrated, but the right side portion is operated similarly. The conveyance guide 22 is positioned at the first position disposed upward of the sheet cassette 21 when the sheet cassette 21 is inserted to the apparatus body 20*a*, and can be positioned at the second position when the sheet cassette 21 is drawn from the apparatus body 20*a*.

Figure 8A:
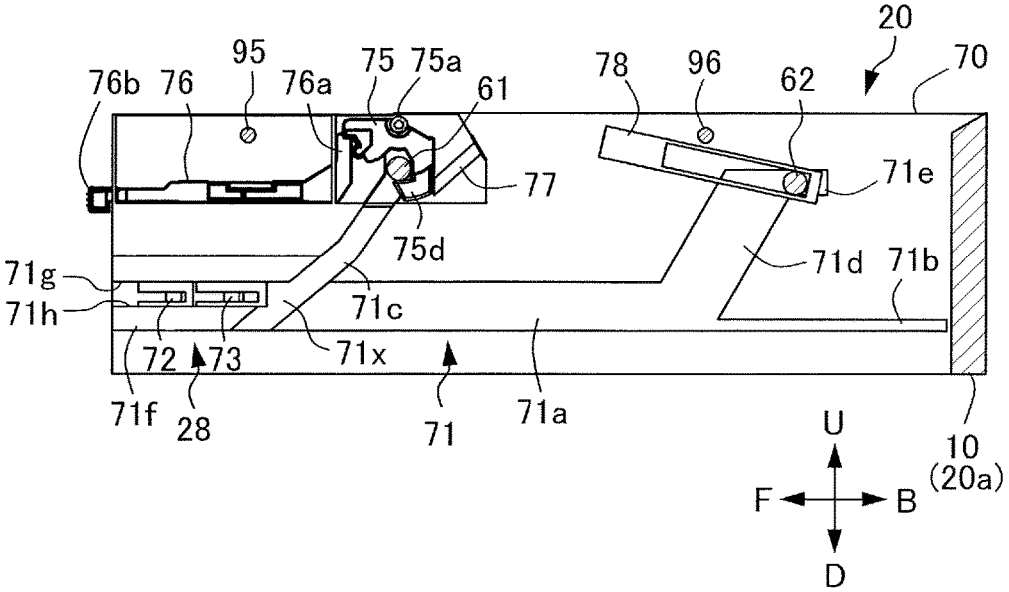
FIG. 8A is a schematic cross-sectional view of a case where a conveyance guide of the sheet supporting apparatus is positioned at a first position according to the first embodiment, illustrating a position of a guide projection.
Figure 8B:
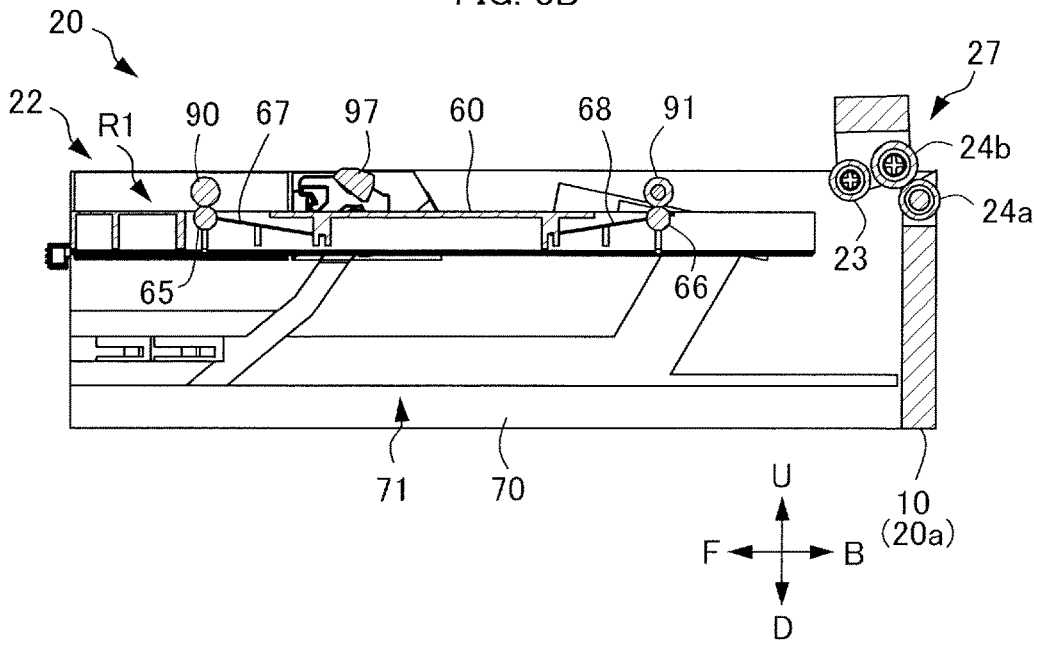
FIG. 8B is a schematic cross-sectional view of a case where the conveyance guide of the sheet supporting apparatus is positioned at the first position according to the first embodiment, illustrating a position of a conveyance guide.

As illustrated in FIGS. 8A and 8B, when the conveyance guide 22 is positioned at the uppermost position, i.e., first position, the guide projection 61 is retained by the engagement portion 75*d* of the latch member 75 and locked by the biasing spring 78. That is, the conveyance guide 22 positioned at the first position has its position determined with respect to the apparatus body 10 by the latch members 75 and 85 supporting the guide projections 61 and 63 at both sides in the width direction, and constitutes the sheet conveyance path R1. The first position is a position at which the sheet conveyance path R1 is constituted. The guide projection 62 is positioned at the rear side step portion 71*e*. At this time, the driven rollers 65 and 66 are in pressure contact with drive rollers 90 and 91 of the apparatus body 10 via biasing springs 67 and 68. In other words, the biasing springs 67 and 68 bias the conveyance guide 22 positioned at the first position toward the second position. Further, the sheet conveyance path R1 is formed between the driven rollers 65 and 66 and the drive rollers 90 and 91.

Figure 9A:
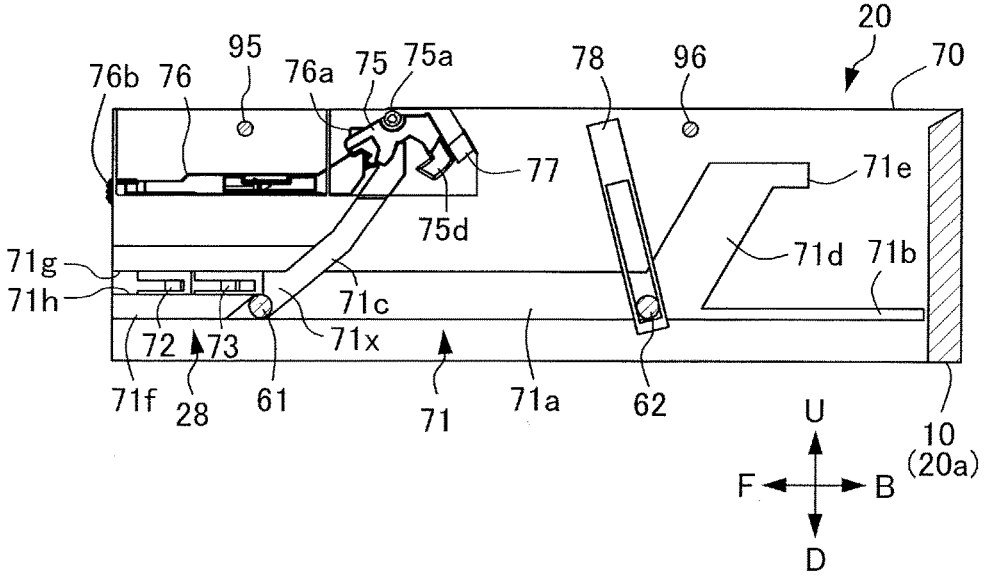
FIG. 9A is a schematic cross-sectional view of a case where the conveyance guide of the sheet supporting apparatus is positioned at a third position according to the first embodiment, illustrating a position of the guide projection.
Figure 9B:
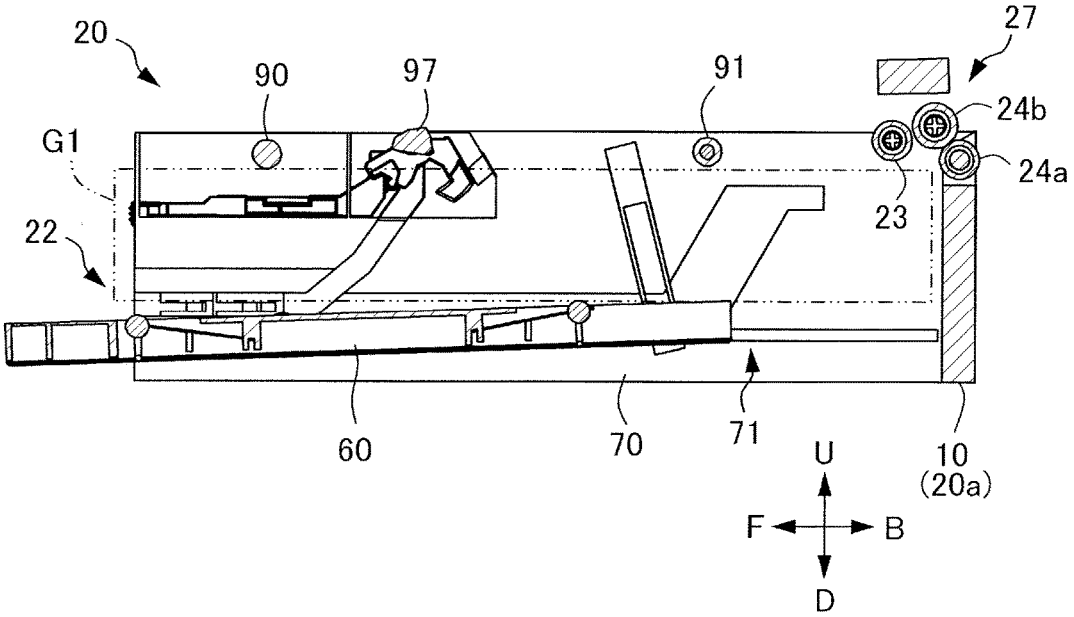
FIG. 9B is a schematic cross-sectional view of a case where the conveyance guide of the sheet supporting apparatus is positioned at the third position according to the first embodiment, illustrating a position of the conveyance guide.

Thus, when the user presses the pressing portion 76*b* of the operation lever 76, the operation lever 76 moves backward B, and rotates the latch member 75 in a clockwise direction against the biasing spring 77. Thereby, the guide projection 61 is disengaged from the engagement portion 75*d* of the latch member 75, and is lowered along the front side oblique portion 71*c*. Along therewith, the guide projection 62 is pressed frontward F by the link member 79 and lowered from the rear side step portion 71*e* along the rear side oblique portion 71*d*. As a result, as illustrated in FIGS. 9A and 9B, the conveyance guide is positioned at a third position which is the lowermost position. The third position of the conveyance guide 22 is positioned downstream, in the drawing direction, of the first position, and the second position of the conveyance guide 22 is positioned downstream, in the drawing direction, of the third position.

Now, if the conveyance guide 22 is inclined with respect to the horizontal plane while being lowered, and the guide projections 61 through 64 are caught by the guide grooves 71 and 81, the lowering of the conveyance guide 22 may not be started, and the guide 22 may be stopped in a state where a space G1 cannot be ensured. In contrast, according to the present embodiment, the conveyance guide 22 is lowered toward the second position by a force greater than its own weight, through the biasing force of the biasing springs 67 and 68 applied to the conveyance guide 22 at the first position. That is, when the operation lever 76 is operated and the conveyance guide 22 is moved from the first position to the second position, the force releasing the transfer nip is applied to the conveyance guide 22. Thereby, supporting of the operation freeing the sheet conveyance path is enabled, and a space G1 can be ensured.

As illustrated in FIGS. 9A and 9B, when the conveyance guide 22 is positioned at the third position, both the guide projections 61 and 62 are positioned at the horizontal portion 71*a*, and the guide projection 61 is in contact with the stopper 71*f*. Both the guide projections 61 and 62 are positioned at the horizontal portion 71*a*, so that the conveyance guide 22 positioned at the third position can form a large space G1 in upward and downward direction with the drive rollers 90 and 91. Therefore, third position is positioned at an appropriate position for treating sheet jamming. That is, at the third position, the conveyance guide 22 is allowed to move toward the inserting direction.

When moving the conveyance guide 22 positioned at the third position to the first position, the user holds the guide plate 60, and elevates the plate 60 while inserting the plate in the inserting direction. Thereby, the guide projection 61 is elevated along the front side oblique portion 71*c*, and the guide projection 62 is elevated along the rear side oblique portion 71*d*. Then, the guide projection 61 presses the inclined plane 75*c* of the latch member 75, rotates the latch member 75 against the biasing spring 78, and is engaged to the engagement portion 75*d*. Thereby, as illustrated in FIG. 8, the conveyance guide 22 is locked to the first position.

Figure 10A:
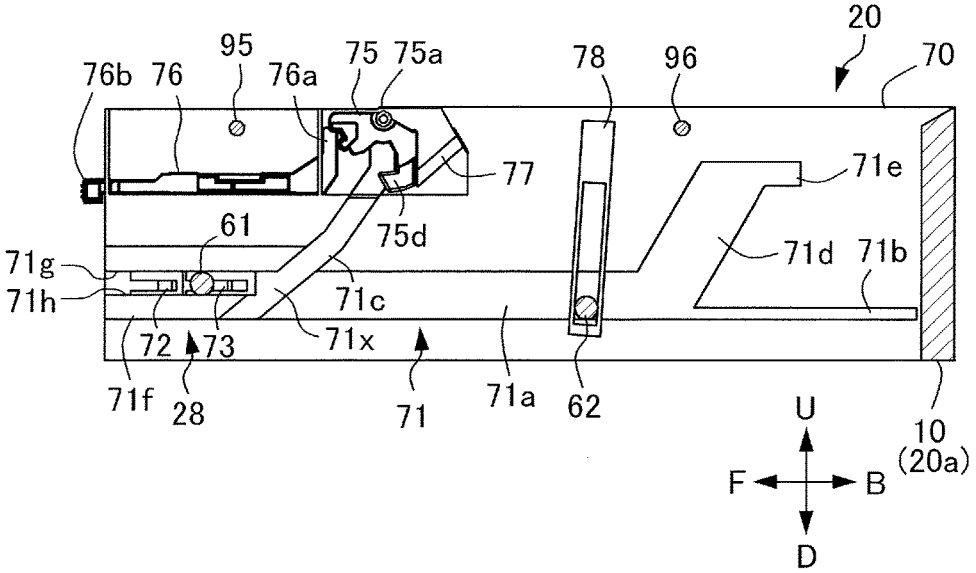
FIG. 10A is a schematic cross-sectional view of a case where the conveyance guide of the sheet supporting apparatus is positioned at a second position according to the first embodiment, illustrating a position of the guide projection.
Figure 10B:
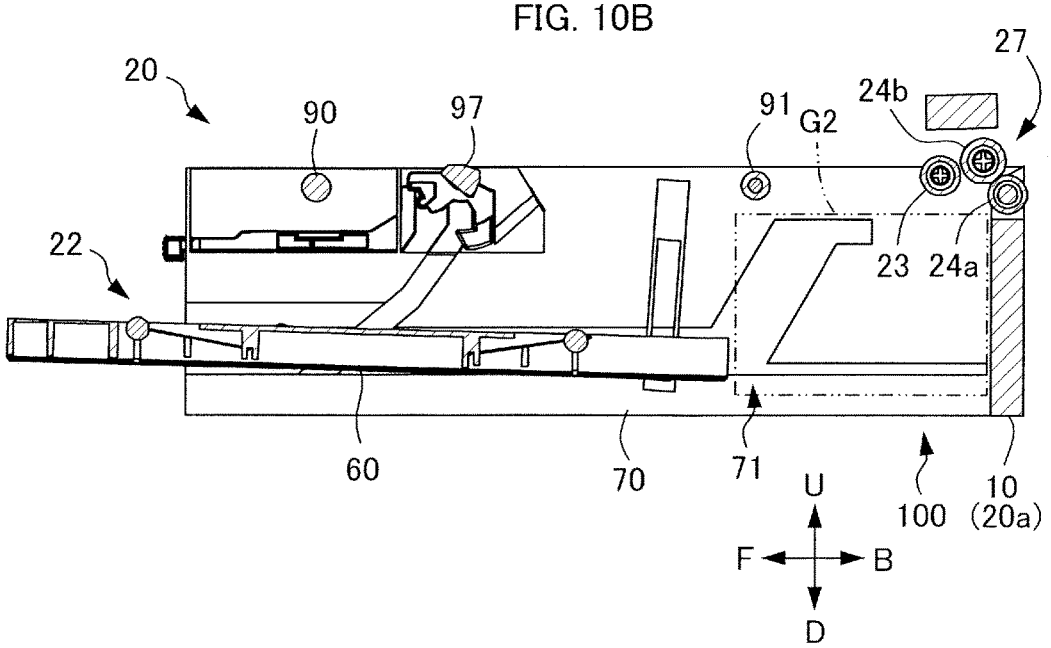
FIG. 10B is a schematic cross-sectional view of a case where the conveyance guide of the sheet supporting apparatus is positioned at the second position according to the first embodiment, illustrating a position of the conveyance guide.

Further, as illustrated in FIGS. 9A and 9B, when the user holds the guide plate 60 and moves the plate upward U and in the drawing direction, i.e., frontward F, in the state where the conveyance guide 22 is positioned at the third position, the guide projection 61 is engaged with the second mold spring 73. In this case, as illustrated in FIG. 10A, the guide projection 61 is guided by the inclined plane 73*b* of the second mold spring 73, elastically deforms and goes over the second mold spring 73, to be positioned between the second mold spring 73 and the first mold spring 72 (refer to FIG. 12). As illustrated in FIGS. 10A and 10B, the position of the conveyance guide 22 in this state is the second position. That is, the second position of the conveyance guide 22 is positioned downward D of the first position, where the conveyance guide 22 exposes the sheet conveyance path R1.

In this state, since the first mold spring 72 has a stopper plane 72*b* facing the backward direction, the guide projection 61 will not go over the stopper plane 72*b* even when it is biased toward the drawing direction, and the guide projection is fixed to this position. That is, the regulation unit 28 regulates the guide projection 61 of the conveyance guide 22 positioned at the second position from moving in the upward direction, i.e., upward U, downward direction, i.e., downward D, drawing direction, i.e., frontward F, and inserting direction, i.e., backward B. Further, in the state where the conveyance guide 22 is positioned at the second position, the first mold springs 72 and 82 contact the guide projections 61 and 63 when the guide projections 61 and 63 are biased toward the drawing direction, by which the movement of the conveyance guide 22 toward the drawing direction is regulated. Moreover, in the state where the conveyance guide 22 is positioned at the second position, the second mold springs 73 and 83 contact the guide projections 61 and 63 when the guide projections 61 and 63 are biased toward the inserting direction, by which the movement of the conveyance guide 22 toward the inserting direction is regulated. That is, the first mold springs 72 and 82 and the second mold springs 73 and 83 are disposed to protrude to the inner side of the horizontal portions 71*a* and 81*a* at the drawing direction side than the intersect portions 71*x* and 81*x* of the horizontal portions 71*a* and 81*a*, and regulate the movement of the guide projections 61 and 63 positioned at the second position in the drawing and inserting directions.

Upper walls 71*g* and 81*g* of the guide grooves 71 and 81 contact the guide projections 61 and 63 when the guide projections 61 and 63 are biased upward U, by which the movement of the conveyance guide 22 toward the upward direction is regulated. Upper surfaces 71*h* and 81*h* of the stoppers 71*f* and 81*f* contact the guide projections 61 and 63 when the guide projections 61 and 63 are biased downward D, by which the movement of the conveyance guide 22 toward the downward direction is regulated. That is, the upper walls 71*g* and 81*g* and the upper surfaces 71*h* and 81*h* form upper and lower walls of the horizontal portions 71*a* and 81*a* at the drawing direction side than the intersect portions 71*x* and 81*x* of the horizontal portions 71*a* and 81*a*, regulating the upward and downward movement of the guide projections 61 and 63 positioned at the second position. When assembling the conveyance guide 22 to the support plates 70 and 80 during assembly of the sheet feeding unit 20, the guide projections 62 and 61 are guided by the inclined plane 72*a* of the first mold spring 72 and inserted to the guide groove 71.

As illustrated in FIGS. 10A and 10B, when the conveyance guide 22 is positioned at the second position, the guide projection 61 is drawn out to the front side and fixed by the regulation unit 28, so that the conveyance guide 22 positioned at the second position is protruded to the drawing direction than the first and third positions. Thereby, a large space G2 can be formed between the trailing edge of the conveyance guide 22 and the roller unit 27. Therefore, the second position is set to an appropriate position for replacing the roller unit 27 and the like. That is, the second position of the conveyance guide 22 is a position in which the conveyance guide 22 forms a space G2 between the apparatus body 10 for removing and attaching the roller unit 27, and it is a position where the roller unit 27 is exposed to the exterior through the opening 100. Thus, the roller unit 27 can be replaced when the conveyance guide 22 is positioned at the second position. Similarly, the opening 100 exposes the drive roller 91 to the exterior when the conveyance guide 22 is positioned at the second position. Thereby, the drive roller 91 can be maintained or replaced when the conveyance guide 22 is positioned at the second position.

When moving the conveyance guide 22 positioned at the second position to the third position, the user holds the guide plate 60 and inserts the plate 60 with a sufficient force toward the inserting direction. Thereby, the guide projection 61 is guided by the inclined plane 73*a* of the second mold spring 73, elastically deforms and goes over the second mold spring 73, to be positioned at the horizontal portion 71*a* and to be lowered along the front side oblique portion 71*c* so that the conveyance guide 22 is positioned at the third position (refer to FIGS. 9A and 9B).

Figure 11:
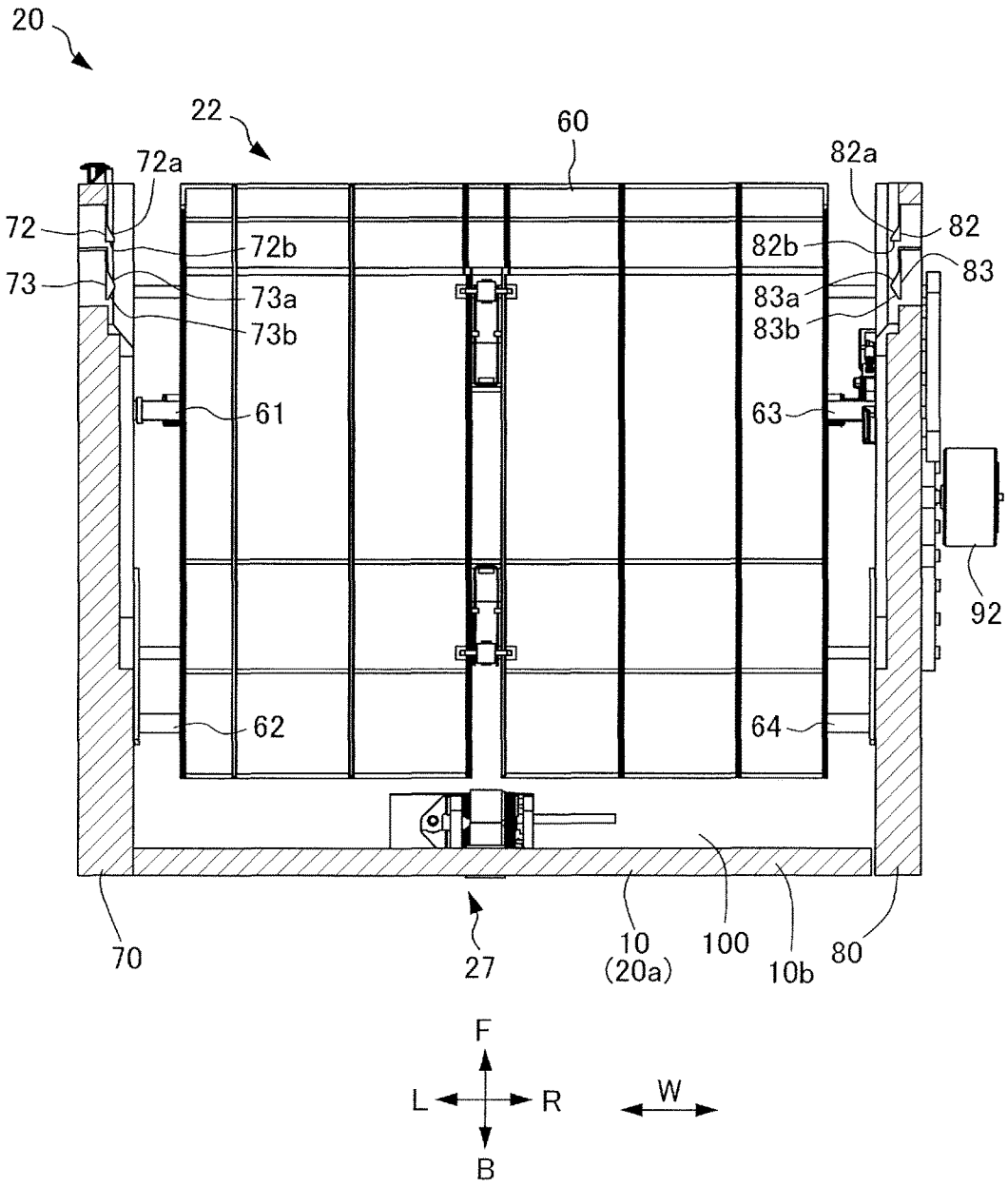
FIG. 11 is a schematic cross-sectional view of a case where the conveyance guide according to the first embodiment is positioned at the first position, with the sheet supporting apparatus turned 90 degrees and erected.
Figure 12:
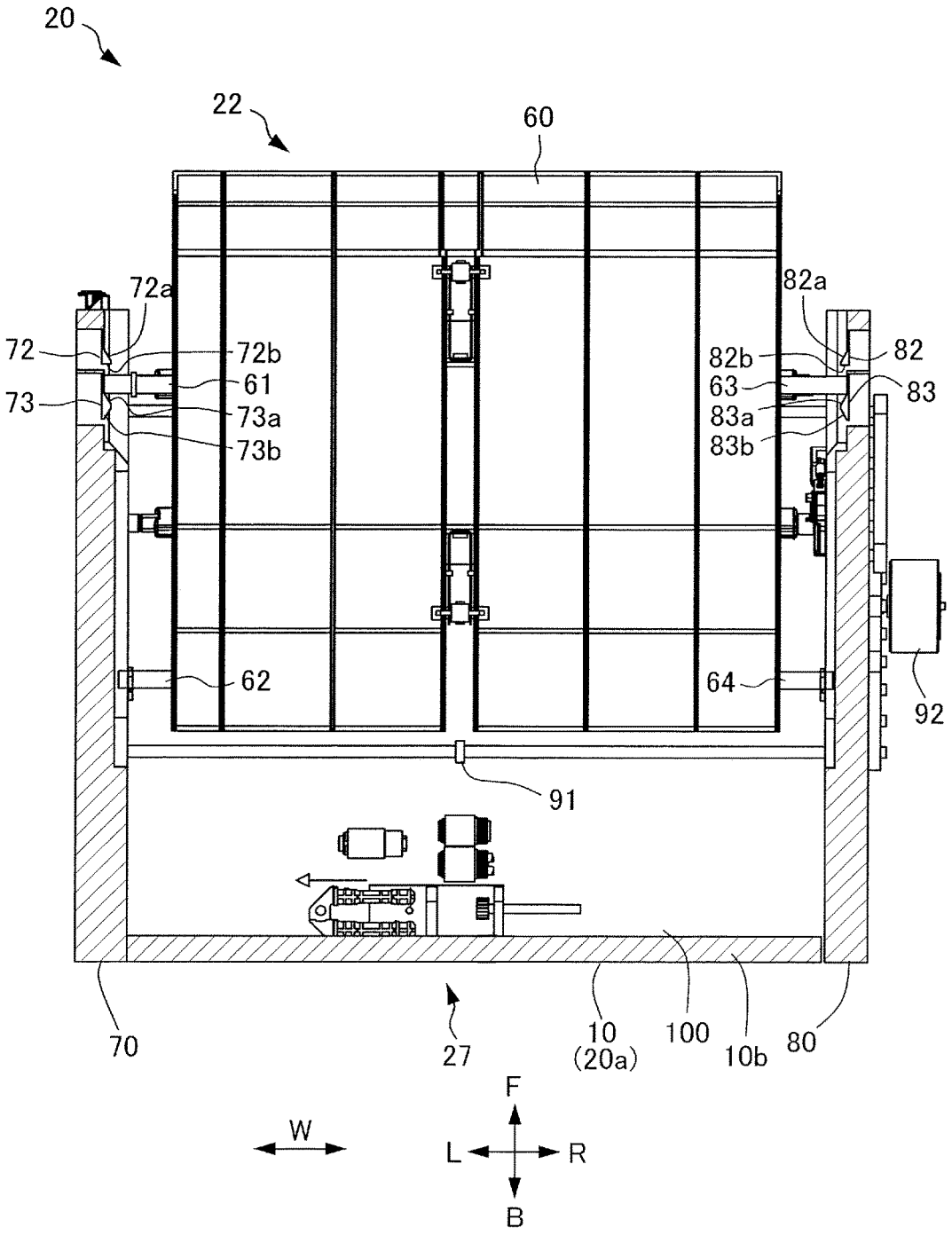
FIG. 12 is a schematic cross-sectional view of a case where the conveyance guide according to the first embodiment is positioned at the third position, with the sheet supporting apparatus turned 90 degrees and erected.

Next, the operation for performing replacement of the roller unit 27 in the sheet feeding unit 20 described above will be described in detail with respect to FIGS. 11 and 12.

The user pulls out the sheet cassette 21, and rotates the image forming apparatus 1 for 90 degrees so that the apparatus 1 is erected with the rear side of the image forming apparatus 1 positioned downward D. At this time, the conveyance guide 22 is positioned at the first position, so that when the sheet feeding unit 20 is viewed from a bottom side, as illustrated in FIG. 11, the roller unit 27 is exposed to the exterior through the opening 100. However, when the conveyance guide 22 is positioned at the first position, the opening 100 is narrow, and the workability of replacing the roller unit 27 will be deteriorated.

Then, the user operates the operation lever 76 to unlock the lock of the conveyance guide 22, holds the guide plate 60, and moves the position of the conveyance guide 22 from the first position to the second position. Thereby, as illustrated in FIG. 12, the opening 100 is opened wide and the conveyance guide 22 is fixed by the regulation unit 28, so that the workability of replacing the roller unit 27 is improved.

When the replacement operation is completed, the user moves the guide plate 60 with sufficient force to unlock the lock at the second position and move the guide plate to the first position, to prepare for the subsequent printing process.

As described above, according to the sheet feeding unit of the present embodiment, the second position is distant from the first position opposed to the sheet conveyance path R1, so that replacement of the roller unit 27 and the like can be performed when the conveyance guide 22 is positioned at the second position. The regulation unit 28 regulates the conveyance guide 22 positioned at the second position from moving upward U, downward D, in the drawing direction, i.e., frontward F, and in the inserting direction, i.e., backward B, with respect to the conveyance guide 22. Thereby, the workability of replacing the roller unit 27 and the like can be improved, even with the movable conveyance guide 22 disposed on the apparatus body 10.

According further to the sheet feeding unit 20 of the present embodiment, the conveyance guide 22 can be positioned at the third position suitable for treating sheet jamming, in addition to the first and second positions. Therefore, the workability regarding sheet jam can be improved.

According further to the sheet feeding unit 20 of the present embodiment, the regulation unit 28 is disposed at a position not interfering with the guide grooves 71 and 81. Therefore, the regulation unit 28 does not affect the movement of the conveyance guide 22 and the sheet cassette 21, and does not deteriorate the usability of the apparatus by the user.

Second Embodiment

Figure 13A:
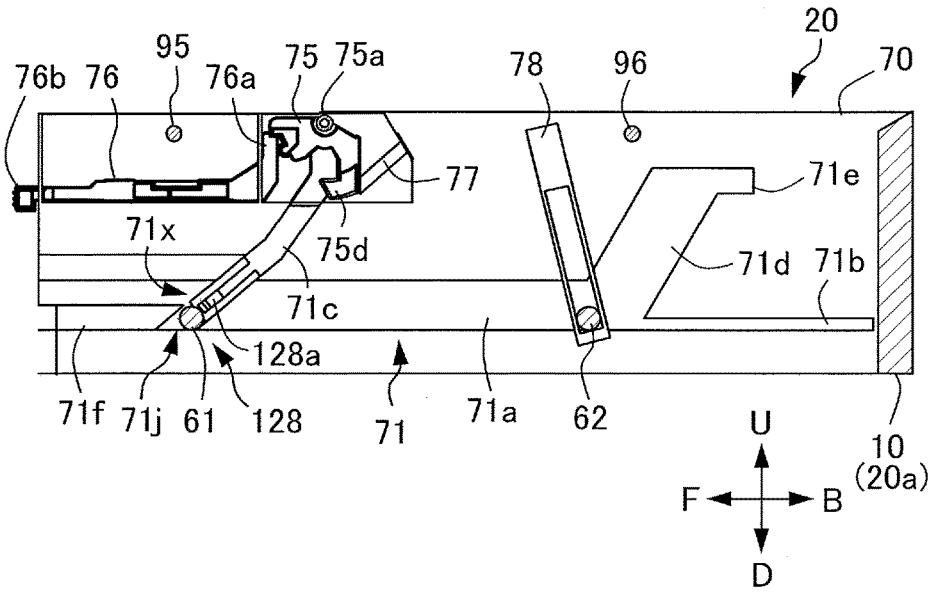
FIG. 13A is a schematic cross-sectional view of a case where the conveyance guide according to the second embodiment is positioned at the second position, illustrating the position of the guide projection.
Figure 13B:
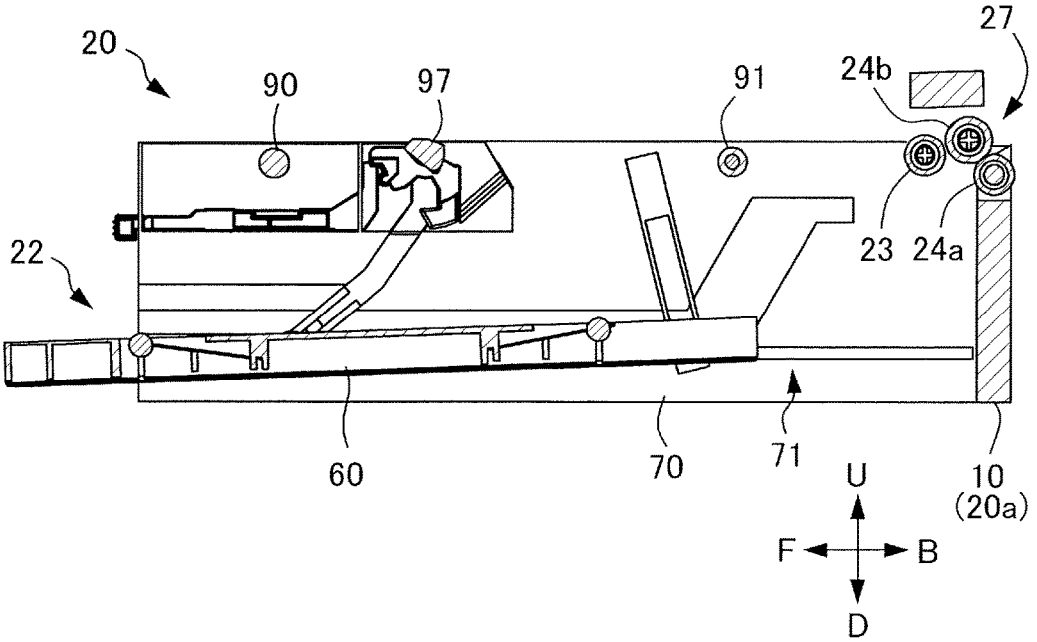
FIG. 13B is a schematic cross-sectional view of a case where the conveyance guide of the sheet supporting apparatus according to the second embodiment is positioned at the second position, illustrating the position of the conveyance guide.

Next, the second embodiment of the present invention will be described in detail with reference to FIGS. 13A and 13B. In the present embodiment, the position for forming a regulation unit 128 differs from the regulation unit 28 of the first embodiment, but the other configurations are similar, so that the similar configurations are denoted by the same reference numbers, and detailed descriptions thereof are omitted.

In the present embodiment, the regulation unit 128 is disposed lower portion of the front side oblique portion 71*c*. The regulation unit 128 has a mold spring, that is, contact portion, 128*a* having an inclined plane respectively inclined toward the upward and downward directions, as in the second mold springs 73 and 83 of the first embodiment. Therefore, when the guide projection 61 is lowered along the front side oblique portion 71*c* during the movement of the conveyance guide 22 from the first position, the guide projection 61 contacts the mold spring 128*a*. In this case, the guide projection 61 is guided by the inclined plane facing upward U of the mold spring 128*a*, and as illustrated in FIG. 13A, elastically deforms and goes over the mold spring 128*a*, to be positioned between the mold spring 128*a* and the stopper 71*f*. At this time, the position of the conveyance guide 22 is the second position.

When moving the conveyance guide 22 positioned at the second position to the first position, the user holds the guide plate 60, and pushes the plate upward U with sufficient force. Thereby, the guide projection 61 is guided by the inclined plane facing downward D of the mold spring 128*a*, elastically deforms and goes over the mold spring 128*a*, passes through the front side oblique portion 71*c* to be positioned at the first position.

That is, the guide groove 71 includes the horizontal portion 71*a* disposed horizontally from the drawing direction side toward the inserting direction of the apparatus body 20*a*, and the front side oblique portion 71*c* intersecting the horizontal portion 71*a* at the intersect portion 71*x* and disposed diagonally upward U in the inserting direction from the intersect portion 71*x*, regulating the guide projection 61 in the downward direction and in the drawing and inserting direction at the downward side D than the intersect portion 71*x*. Then, when the conveyance guide 22 is positioned at the first position, the guide projection 61 is positioned at the uppermost position of the front side oblique portion 71*c*, and when the conveyance guide 22 is positioned at the second position, the guide projection 61 is positioned downward D than the intersect portion 71*x* of the front side oblique portion 71*c*. Further, the regulation unit 128 includes a wall 71*j* of the front side oblique portion 71*c* regulating the guide projection 61 in the drawing and inserting direction and in the downward direction at the downward side D than the intersect portion 71*x* when the conveyance guide 22 is positioned at the second position, and the mold spring 128*a* regulating the movement in the upward direction of the guide projection 61 by protruding to the inner side of the front side oblique portion 71*c* and being in contact with the guide projection 61 when the projection 61 is biased in the upward direction.

Also according to the sheet feeding unit 20 of the present embodiment, the second position is distant from the first position opposed to the sheet conveyance path R1, so that replacement of the roller unit 27 and the like can be performed when the conveyance guide 22 is positioned at the second position. The regulation unit 28 regulates the conveyance guide 22 positioned at the second position from moving upward U, downward D, in the drawing direction, i.e., frontward F, and in the inserting direction, i.e., backward B, with respect to the conveyance guide 22. Thereby, the workability of replacing the roller unit 27 and the like can be improved, even with the movable conveyance guide 22 disposed on the apparatus body 10.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-108834, filed May 28, 2015, which is hereby incorporated by reference herein in its entirety.

What is claimed is:

1. A sheet supporting apparatus comprising:

an apparatus body comprising a conveyance guidance portion;

a supporting unit, configured to be drawn from and inserted to the apparatus body, comprising a supporting member on which a sheet is supported;

a conveyance guide, comprising a first engagement portion and a second engagement portion that engage with the conveyance guidance portion, configured to move between a first position at which a sheet conveyance path is constituted and a second position corresponding to a position of the conveyance guide drawn from the first position along the conveyance guidance portion, the second engagement portion being disposed further downstream in a drawing direction of the supporting unit than the first engagement portion; and a regulation unit regulating the conveyance guide positioned at the second position from moving in an inserting direction of the supporting unit in a state where the first and second engagement portions engage with the conveyance guidance portion.

2. The sheet supporting apparatus according to claim 1, wherein the conveyance guide is positioned at the first position disposed upward of the supporting unit in a state where the supporting unit is inserted to the apparatus body, and configured to be moved to the second position in a state where the supporting unit is drawn from the apparatus body.

3. The sheet supporting apparatus according to claim 1, wherein the second position of the conveyance guide is positioned below the first position and it is a position in which the conveyance guide opens the sheet conveyance path.

4. The sheet supporting apparatus according to claim 1, further comprising a roller portion disposed on the apparatus body, the roller portion configured to be removed from the apparatus body in a state where the conveyance guide is positioned at the second position.

5. The sheet supporting apparatus according to claim 4, wherein the roller portion is attached in a removable manner to the apparatus body, and a space is formed between the conveyance guide and the apparatus body to attach and remove the roller portion in a state where the conveyance guide is positioned at the second position.

6. The sheet supporting apparatus according to claim 4, wherein the apparatus body comprises a bottom portion defining an opening through which the roller portion is exposed to an exterior of the apparatus body, and the second position of the conveyance guide is a position in which the roller portion is exposed to the exterior of the apparatus body through the opening.

7. The sheet supporting apparatus according to claim 4, wherein the roller portion comprises a feed roller configured to feed a sheet supported on the supporting member, a separation unit, and a conveyance roller disposed downstream, in a sheet conveyance direction, of the feed roller and separating a sheet fed from the feed roller one at a time by cooperating with the separation unit, the roller portion being replaceable with respect to the apparatus body in a state where the conveyance guide is positioned at the second position.

8. The sheet supporting apparatus according to claim 4, wherein the conveyance guide comprises a first roller portion disposed upstream, in a sheet conveyance direction, of the roller portion, the apparatus body comprises a second roller portion configured to be in contact with the first roller portion, and a bottom portion defining an opening, and the second position of the conveyance guide is a position where the second roller portion is exposed to an exterior of the apparatus body through the opening.

9. The sheet supporting apparatus according to claim 1, further comprising an operating unit configured to move the conveyance guide positioned at the first position, wherein the conveyance guide is moved downward from the first position to a third position by operating the operating unit, and in the third position, the conveyance guide can be moved in the inserting direction.

10. The sheet supporting apparatus according to claim 9, wherein the third position of the conveyance guide is positioned below the first position and the second position.

11. The sheet supporting apparatus according to claim 1, further comprising a lock unit configured to lock the conveyance guide to the first position, and an unlock unit configured to unlock the lock unit.

12. The sheet supporting apparatus according to claim 11, further comprising a biasing portion biasing the conveyance guide at the first position toward the second position.

13. The sheet supporting apparatus according to claim 1, wherein the first and second engagement portions are disposed at an end portion side in a width direction orthogonal to the upward and downward directions, and the drawing and inserting directions of the conveyance guide, the conveyance guidance portion guides the conveyance guide to the first position and the second position, and the regulation unit regulates the movement of the first and second engagement portions in the upward direction, the downward direction, the drawing direction and the inserting direction with respect to the apparatus body in a state where the conveyance guide is positioned at the second position.

14. The sheet supporting apparatus according to claim 13, wherein the regulation unit comprises a first contact portion regulating the movement of the first or second engagement portion in the drawing direction by being in contact with the first or second engagement portion in a state where the first or second engagement portion of the conveyance guide positioned at the second position is biased toward the drawing direction, a second contact portion regulating the movement of the first or second engagement portion in the inserting direction by being in contact with the first or second engagement portion in a state where the first or second engagement portion of the conveyance guide positioned at the second position is biased toward the inserting direction, a first wall portion constituting a part of the conveyance guidance portion, and regulating the movement of the first or second engagement portion in the upward direction by being in contact with the first or second engagement portion in a state where the first or second engagement portion of the conveyance guide positioned at the second position is biased upward, and a second wall portion constituting a part of the conveyance guidance portion, and regulating the movement of the first or second engagement portion in the downward direction by being in contact with the first or second engagement portion in a state where the first or second engagement portion of the conveyance guide positioned at the second position is biased downward.

15. The sheet supporting apparatus according to claim 13, wherein the first and second engagement portions comprise a pin member protruding in the width direction, the conveyance guidance portion defines a horizontal portion formed horizontally from the drawing direction side toward the inserting directions of the apparatus body, and an oblique portion intersecting the horizontal portion at an intersect portion and extended diagonally in the upward and inserting directions from the intersect portion, and regulating the pin member in an area below the intersect portion from moving in the drawing and inserting directions and in the downward direction, the pin member is positioned at an uppermost portion of the oblique portion in a case where the conveyance guide is positioned at the first position, and the pin member is positioned below the intersect portion of the horizontal portion in a case where the conveyance guide is positioned at the second position, and the regulation unit comprises a wall portion of the oblique portion regulating the pin member in an area below the intersect portion from moving in the drawing and inserting directions and in the downward direction in a case where the conveyance guide is positioned at the second position, and a contact portion disposed to protrude from an inner side of the oblique portion and regulating the pin member in an area below the intersect portion from moving in the upward direction by being in contact with the pin member in a state where the pin member of the conveyance guide positioned at the second position is biased upward.

16. A sheet supporting apparatus comprising:

an apparatus body;

a supporting unit configured to be drawn from and inserted to the apparatus body, and comprising a supporting member on which a sheet is supported;

a conveyance guide disposed on the apparatus body and configured to move to a first position at which a sheet conveyance path is constituted, and a second position distant from the first position;

a regulation unit regulating the conveyance guide positioned at the second position from moving in an upward direction, a downward direction, a drawing direction and an inserting direction of a supporting unit; and an operating unit configured to move the conveyance guide positioned at the first position, wherein the conveyance guide is moved downward from the first position to a third position by operating the operating unit, and in the third position, the conveyance guide can be moved in the inserting direction, and wherein the third position of the conveyance guide is positioned downstream, in the drawing direction, of the first position, and the second position of the conveyance guide is positioned downstream, in the drawing direction, of the third position.

17. An image forming apparatus comprising:

a sheet supporting apparatus comprising:

an apparatus body comprising a conveyance guidance portion;

a supporting unit, configured to be drawn from and inserted to the apparatus body, comprising a supporting member on which a sheet is supported;

a conveyance guide, comprising a first engagement portion and a second engagement portion that engage to the conveyance guidance portion, configured to move between a first position at which a sheet conveyance path is constituted and a second position corresponding to a position of the conveyance guidance portion, the second engagement portion being disposed further downstream in a drawing direction of the supporting unit than the first engagement portion; and a regulating unit regulating the conveyance guide positioned at the second position from moving in an inserting direction of the supporting unit in a state where the first and second engagement portions engage to the conveyance guidance portion;

a sheet conveyance unit configured to convey a sheet supported on the sheet supporting apparatus; and an image forming unit configured to form an image on a sheet conveyed by the sheet conveyance unit.

* * * * *